US006356012B1

(12) United States Patent
Bae

(10) Patent No.: US 6,356,012 B1
(45) Date of Patent: Mar. 12, 2002

(54) CRT PANEL AND A METHOD FOR MANUFACTURING THE SAME

(75) Inventor: Sung-ryong Bae, Kyeongsangnam-do (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/209,546

(22) Filed: Dec. 11, 1998

(30) Foreign Application Priority Data

Dec. 17, 1997 (KR) ..... 97-69884

(51) Int. Cl.[7] ..... H01J 31/12; H01J 29/18
(52) U.S. Cl. ..... 313/479; 313/478; 313/461
(58) Field of Search ..... 313/461, 473, 313/478, 479, 480, 112, 114, 116

(56) References Cited

U.S. PATENT DOCUMENTS 3,879,627 A * 4/1975 Robinder ..... 313/116
4,841,372 A * 6/1989 Lee ..... 358/247
5,045,750 A * 9/1991 Itou et al. ..... 313/466

* cited by examiner

*Primary Examiner*—Nimeshkumar D. Patel
*Assistant Examiner*—Karabi Guharay
(74) *Attorney, Agent, or Firm*—Christie, Parker & Hale, LLP

(57) ABSTRACT

Disclosed is a CRT panel. The panels includes a display portion defining a distal end of the panel; a curved lateral wall extending from the display portion toward a funnel of the CRT, ends of the lateral wall being joined to the funnel; a phosphor screen formed on an inside surface of the display portion, the phosphor screen including RGB phosphor pixels and a black matrix layer between the RGB phosphor pixels; and light transmittance compensating means for compensating for differences in brightness of the phosphor screen. The light transmittance compensating means is provided on an outside surface of the display portion and has varying levels of light transmittivity over its surface.

11 Claims, 2 Drawing Sheets

CRT PANEL AND A METHOD FOR MANUFACTURING THE SAME

FIELD OF THE INVENTION

The present invention relates to a panel for a cathode ray tube (CRT), and more particularly, to a CRT panel and a method for manufacturing the same in which the entire area of a viewing screen is uniformly illuminated.

BACKGROUND OF THE INVENTION

CRTs generally comprise a panel defining a front exterior of the CRT, and a funnel joined to the panel to define a rear exterior of the CRT. The funnel includes a neck which is formed on an end of the funnel opposite to the end joined to the panel, and an electron gun is provided in the neck of the funnel. The panel includes a display portion defining a distal end of the panel, a lateral wall curved and extending toward the funnel to be joined to the same, a phosphor screen provided adjacent to the display portion within the CRT, a mask frame connected to the lateral wall of the panel, and a shadow mask joined to the mask frame at a predetermined distance from the phosphor screen.

The electron gun radiates red (R), green (G) and blue (B) electron beams in a direction toward the panel. The RGB electron beams are controlled by image signals such that the beams are deflected to specific pixels by an electrical field generated by a deflection yoke, the deflection yoke being disposed on an outer circumference of the funnel. The deflected electron beams pass through apertures of the shadow mask to land on specific RGB phosphor pixels of the phosphor screen such that color selection of the electron beams by the shadow mask is realized. Accordingly, the RGB phosphors of the phosphor screen are illuminated for the display of color images.

As shown in FIG. 4, illustrating the conventional shadow mask 1 having apertures 3 formed therein, spaces between the apertures 3 become increasingly larger toward a periphery of the shadow mask 1. That is, positions of the apertures 3 on the shadow mask 1 where the electron beams land become spaced farther apart toward outer edges of the same. Such a configuration corresponds to incremental increases in the degree of deflection of the electron beams by the deflection yoke toward the periphery of the shadow mask 1. Without this structure, the electron beams would pass through their designated apertures 3 at the center of the shadow mask 1, but not at the peripheries of the same.

However, with the formation of the shadow mask as in the above, the RGB phosphor pixels on the phosphor screen must also be formed in their dot or stripe matrices with spaces corresponding to the spaces formed between the apertures of the shadow mask. Accordingly, the area of a light-absorbing black matrix layer formed between the dot- or stripe-type phosphor pixels enlarges such that brightness is increasingly reduced toward the peripheries of the display portion.

Therefore, the illumination over the surface of the viewing screen becomes uneven with the center of the viewing screen being brighter than the outer peripheral portions of the same. Assuming that the degree of darkness at the center of the phosphor screen is indexed at 100, the degree of darkness at the periphery of the phosphor screen is 120. In the stripe-type CRT, this translates into a 50% reduction in brightness at the peripheries of the display, whereas a 30% decrease in peripheral brightness results in the dot-type CRT.

Further, as CRTs become increasingly flatter, following advances made in CRT technology, the above problem worsens. That is, differences in the spaces between the apertures of the shadow mask from the center to the peripheries of the same, and therefore the spaces between the phosphor pixels of the phosphor layer, increase as the CRT becomes flatter.

SUMMARY OF THE INVENTION

The present invention has been made in an effort to solve the above problems.

It is an object of the present invention to provide a CRT panel and a method for manufacturing the same in which the entire area of a viewing screen is uniformly illuminated.

To achieve the above object, the present invention provides a CRT panel and a method for manufacturing the same. The CRT panel is made of clear glass and includes a display portion defining a distal end of the panel; a curved lateral wall extending from the display portion toward a funnel of the CRT, ends of the lateral wall being joined to the funnel; a phosphor screen formed on an inside surface of the display portion, the phosphor screen including RGB phosphor pixels and a black matrix layer between the RGB phosphor pixels; and light transmittance compensating means for compensating for differences in brightness of the phosphor screen, the light transmittance compensating means being provided on an outside surface of the display portion and having varying levels of light transmittivity over its surface.

According to a feature of the present invention, the light transmittance compensating means comprises a tinted coating layer colored such that it is dark at a center and gradually becomes increasingly lighter toward a periphery thereof.

According to another feature of the present invention, the main element of the tinted coating layer is a resin-based polymer compound, and pigmentation is added to the resin-based polymer compound. It is preferable that the resin-based polymer compound is tetraethyl o-silicate.

According to yet another feature of the present invention, the coloring for the tinted coating layer is made of one or more materials selected from the group consisting of cobalt oxide, nickel oxide, carbon black and graphite. The tinted coating layer gradually becomes increasingly lighter toward the periphery in direct proportion to an increase of the black matrix area of the phosphor screen toward a periphery of the same.

The method of manufacturing the CRT panel comprises the steps of (a) forming a phosphor screen on an inner surface of the panel by sequentially depositing a black matrix material and RGB phosphor material; and (b) forming light transmittance compensating means on an outer surface of the panel, the light transmittance compensating means having a gradating level of light transmittivity over its surface.

According to a feature of the present invention, in step (a), a tinted coating layer is formed on the outer surface of the panel, the tinted coating layer being increasingly lighter in color toward the outer periphery of a display portion of the panel. One side of the tinted coating layer is coated with an adhesive, which is then applied to the outer surface of the display portion of the panel.

In another aspect, the tinted coating layer is formed on the outer surface of the panel using a printing process.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

A preferred embodiment of the present invention will now be described in detail with reference to the accompanying drawings.

Figure 1:
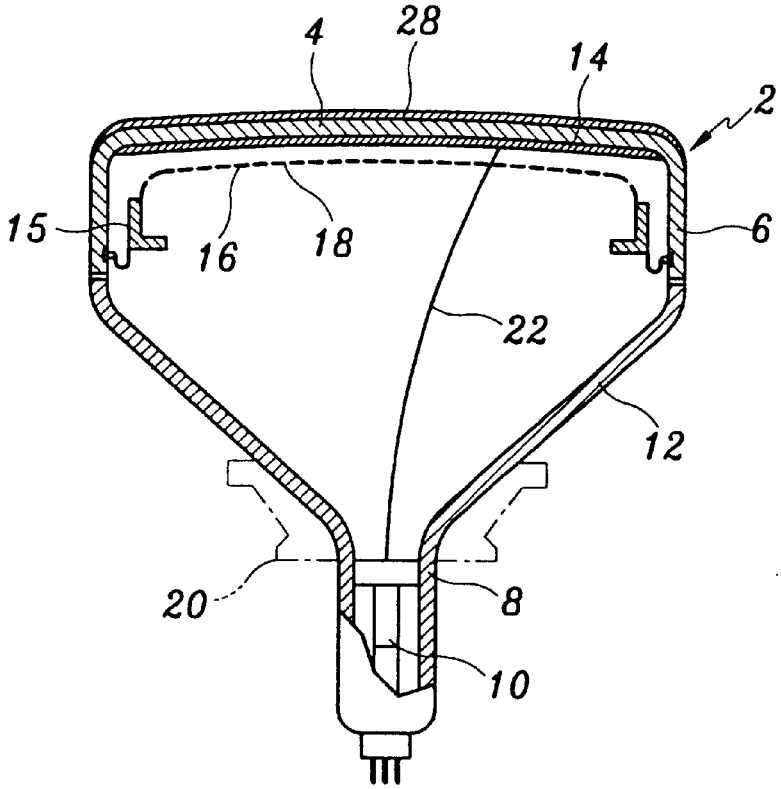
FIG. 1 is a cross-sectional view of a cathode ray tube having a panel according to a preferred embodiment of the present invention.

FIG. 1 shows a cross-sectional view of a cathode ray tube (CRT) having a panel according to a preferred embodiment of the present invention. As shown in the drawing, the CRT comprises a panel 2 defining a front exterior of the CRT, and a funnel 12 joined to the panel 2 to define a rear exterior of the CRT. The panel 2 includes a display portion 4 defining a distal end of the panel 2, and a lateral wall 6 which curves and extends from the display portion toward the funnel 12, ends of the lateral wall 6 being joined to the funnel 12. The funnel 12 includes a neck 8 which is formed on an end of the funnel 12 opposite the end joined to the panel 2, and an electron gun 10 disposed within the neck 8 of the funnel 12.

A phosphor screen 14 is formed on an inside surface of the display portion 4. The phosphor screen 14 includes a black matrix layer, made of a light-absorbing graphite compound; and red (R), green (G) and blue (B) phosphor pixels. A mask frame 15 is attached to the lateral wall 6 and a shadow mask 16 is connected to the mask frame 15 to be suspended substantially parallel to and at a predetermined distance from the phosphor screen 14.

The electron gun 10 radiates RGB electron beams 22 in a direction toward the panel 2. The RGB electron beams 22 are controlled by image signals, which deflect the beams by an electrical field generated by a deflection yoke 20 disposed on an outer circumference of the funnel 12.

A plurality of apertures 18 is formed in the shadow mask 16, and the electron beams 22 emitted from the electron gun 10 pass through the apertures 18. The apertures 18 perform a color selection function of the electron beams 22 such that the electron beams 22 land on designated phosphor pixels of the phosphor screen 14. Spaces between the apertures 18 become increasingly larger toward peripheral portions of the shadow mask 16 to correspond to the increased degree of deflection of the electron beams 22 at the peripheries of the same. That is, since the electron beams 22 are deflected in increasingly larger arcs towards outer portions of the shadow mask 16, the spaces between the apertures 18 formed in the shadow mask 16 increase such that the electron beams 22 can pass precisely through their designated apertures 18.

Accordingly, the RGB phosphor pixels on the phosphor screen 14 must also be formed in their dot or stripe matrixes with spaces corresponding to the spaces formed between the apertures of the shadow mask (i.e., with larger spaces toward peripheries of the phosphor screen 14). However, this enlarges the area of the black matrix layer between the phosphor pixels, which, in turn, reduces the brightness at the periphery of the display portion 4 such that there is a visible difference in the brightness levels between the center and the outer portions of the display area 4.

Figure 2:
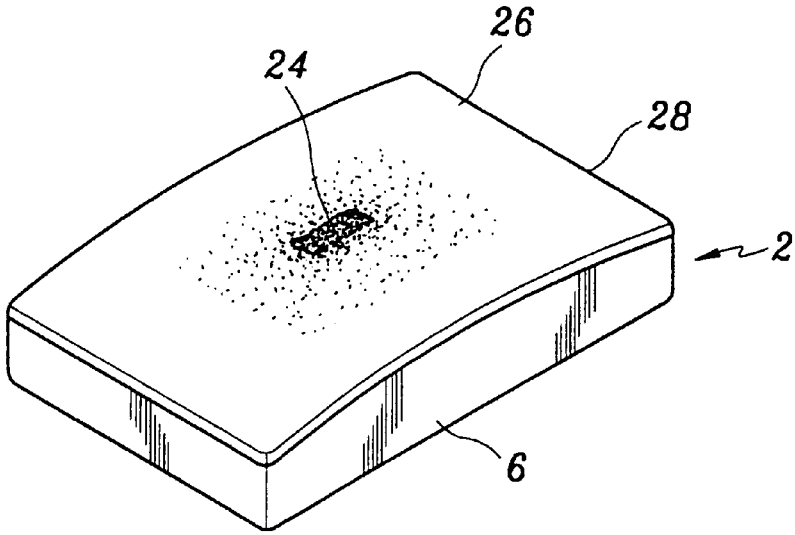
FIG. 2 is a perspective view of the panel shown in FIG. 1.

According to a feature of the present invention, a tinted coating layer 28 is formed on an outer surface of the display portion 4 of the panel 2 which corresponds to the positioning of the phosphor screen 14 formed on the inner surface of the display portion 4. With reference to FIG. 2, the tinted coating layer 28 is dark at a center 24 of the panel, and becomes increasingly lighter toward a periphery 26 thereof.

The main element of the tinted coating layer 28 is a resin-based polymer compound, preferably tetraethyl o-silicate. Preferably the main element used for the pigmentation of the tinted coating layer 28 is either cobalt oxide, nickel oxide or carbon black; or a composition of graphite or cobalt oxide and nickel oxide. The density of pigmentation used for the tinted coating layer 28 varies over the surface of the same. That is, starting from the center of the tinted coating layer 28, a determined amount of pigmentation is used, while the amount of pigmentation decreases in increments toward outer peripheries of the tinted coating layer 28 in direct relation to increases in the surface area of the black matrix on the phosphor screen 14.

With the panel 2 being made of clear glass having a high transmittivity of roughly 85%, the application of the tinted coating layer 28, with gradated degrees of pigmentation as described above, on the display portion 4 of the panel 2 minimizes differences in brightness of the display portion 4 between a center portion and periphery thereof.

The method of manufacturing the panel 2 structured as in the above will be described hereinafter.

Figure 3:
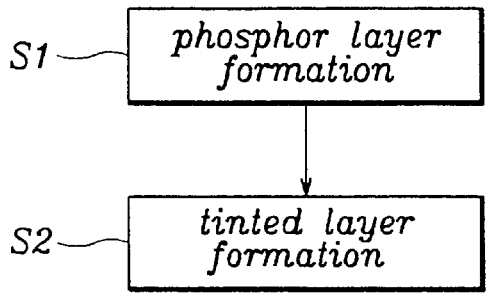
FIG. 3 is a flow chart of a manufacturing method of the panel shown in FIG. 1.
Figure 4:
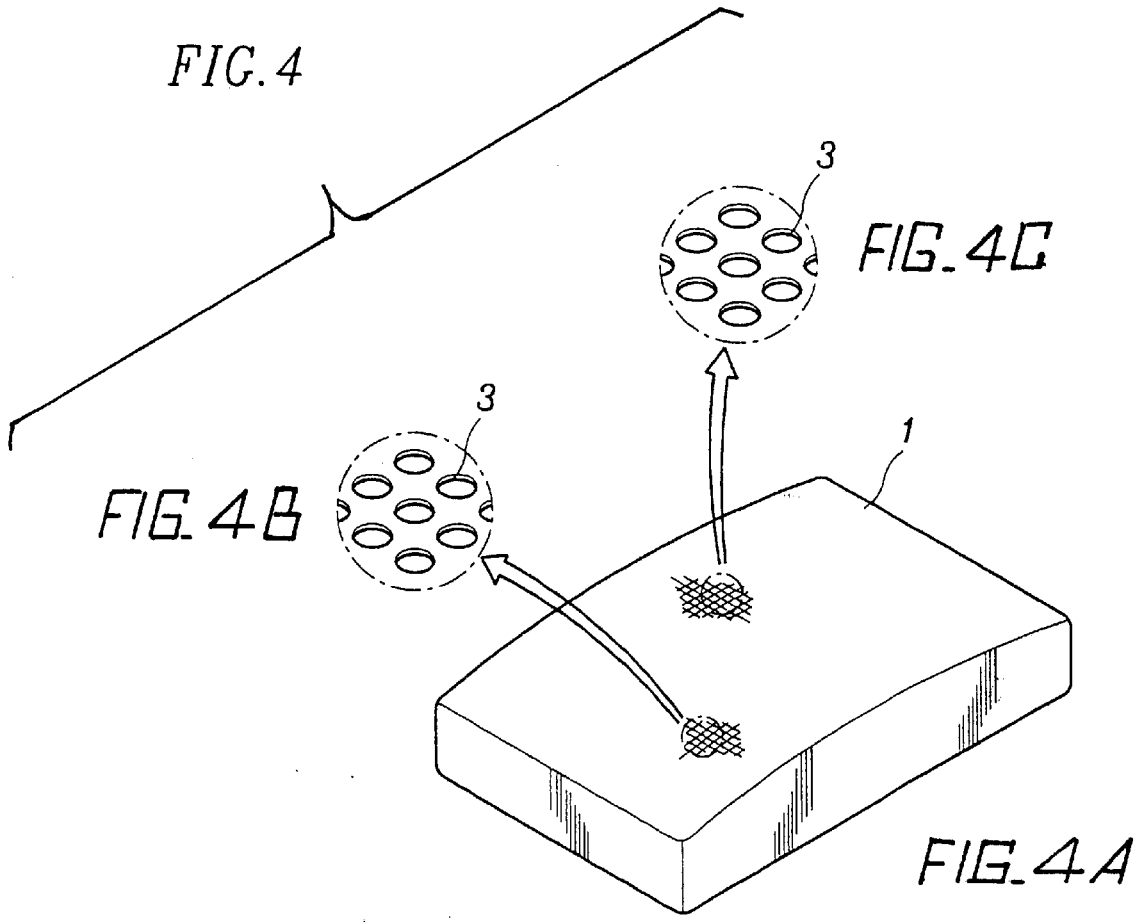
FIG. 4 is a perspective view of a conventional CRT shadow mask.

FIG. 3 is a flow chart of a manufacturing method of the panel 2 according to a preferred embodiment of the present invention. In step S1, the phosphor screen 14 is formed on the inner surface of the display portion 4 of the panel 2 by depositing a black matrix and RGB phosphor material thereon. In step S2, the tinted coating layer 28 is formed on the outer surface of the display portion 4 of the panel 2, the tinted coating layer 28 gradating to a lighter color toward the outer peripheries of the display portion 4.

As mentioned above, the panel 2 is made of clear glass having a transmittivity of approximately 85%. In step S1, as in the conventional method, the panel 2 is coated with an ultraviolet hardening agent, exposed according to a predetermined phosphor pattern, then deposited with a black matrix and developed, thereby completing the formation of the black matrix layer. An RGB slurry compound is coated on the black matrix layer, after which the panel is exposed then developed to complete the formation of the phosphor screen 14 on the inside surface of the display portion 4 of the panel 2.

In step S2, one side of the tinted coating layer 28, which is darkest at the center 24 and gradates lighter toward the periphery 26 as described above, is first coated with an adhesive, then the coated side is applied to the outer surface of the display portion 4 of the panel 2, thereby completing the formation of the tinted coating layer 28.

In another embodiment, the tinted coating layer 28 is printed on the outer surface of the display portion 4 of the panel 2 using a printing process.

With the formation of the tinted coating layer on the panel, the brightness over the entire area of the CRT viewing screen is uniform.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A panel for a CRT comprising:

a display portion defining a distal end of the panel;

a curved lateral wall extending from the display portion;

a phosphor screen formed on an inside surface of the display portion, the phosphor screen including red, green and blue phosphor pixels and a black matrix layer between the red, green and blue phosphor pixels; and light transmittance compensating means for compensating for differences in brightness of the phosphor screen, the light transmittance compensating means being provided on an outside surface of the display portion and having varying levels of light transmittivity over its surface.

2. The CRT panel according to claim 1 wherein the light transmittance compensating means comprises a tinted coating layer that gradates increasingly lighter from a center toward a periphery thereof.

3. The CRT panel according to claim 2 wherein the tinted coating layer comprises a resin-based polymer compound with pigmentation.

4. The CRT panel according to claim 3 wherein the resin-based polymer compound comprises tetraethyl o-silicate.

5. The CRT panel according to claim 3 wherein the pigmentation comprises one or more materials selected from the group consisting of cobalt oxide, nickel oxide, carbon black and graphite.

6. The CRT panel according to claim 1 wherein the panel comprises clear glass.

7. A panel for a CRT comprising:

a display portion defining a distal end of the panel;

a curved lateral wall extending from the display portion;

a phosphor screen formed on an inside surface of the display portion, the phosphor screen including red, green and blue phosphor pixels and a black matrix layer between the red, green and blue phosphor pixels; and light transmittance compensating means provided on an outside surface of the display portion for compensating for differences in brightness of the phosphor screen and comprising a tinted coating layer that gradates increasingly lighter toward its periphery in direct proportion to an increase in surface area of the black matrix on the phosphor screen toward a periphery of the phosphor screen;

wherein the tinted coating layer comprises a resin-based polymer compound with pigmentation.

8. The CRT panel according to claim 7 wherein the resin-based polymer compound comprises tetraethyl o-silicate.

9. The CRT panel according to claim 7 wherein the pigmentation comprises one or more materials selected from the group consisting of cobalt oxide, nickel oxide, carbon black and graphite.

10. A CRT comprising:

a panel having a display portion and a lateral wall extending from the display portion; and a funnel joined to the ends of the lateral wall opposite the display portion, said funnel comprising a neck with an electron gun formed therein;

wherein said panel comprises a phosphor screen formed on an inside surface of the display portion, the phosphor screen including red, green and blue phosphor pixels and a black matrix layer between the red, green and blue phosphor pixels, and a light transmittance compensator that compensates differences in brightness of the phosphor screen, the light transmittance compensator being provided on an outside surface of the display portion and having varying levels of light transmittivity over its surface.

11. A CRT comprising:

a panel having a display portion and a lateral wall extending from the display portion; and a funnel joined to the ends of the lateral wall opposite the display portion, said funnel comprising a neck with an electron gun formed therein;

wherein said panel comprises a phosphor screen formed on an inside surface of the display portion, the phosphor screen including red, green and blue phosphor pixels and a black matrix layer between the red, green and blue phosphor pixels, and a light transmittance compensator provided on an outside surface of the display portion that compensates differences in brightness of the phosphor screen and comprises a tinted coating layer that gradates increasingly lighter toward its periphery in direct proportion to an increase in surface area of the black matrix on the phosphor screen toward a periphery of the phosphor screen.

* * * * *